US011217941B1

(12) United States Patent
Yang

(10) Patent No.: US 11,217,941 B1
(45) Date of Patent: Jan. 4, 2022

(54) ELECTRICAL CONNECTOR SET, AND SOCKET AND PLUG THEREOF

(71) Applicant: ALL BEST PRECISION TECHNOLOGY CO., LTD., Taoyuan (TW)

(72) Inventor: Haven Yang, Taoyuan (TW)

(73) Assignee: ALL BEST PRECISION TECHNOLOGY CO., LTD., Taoyuan (TW)

( * ) Notice: Subject to any disclaimer, the term of this patent is extended or adjusted under 35 U.S.C. 154(b) by 0 days.

(21) Appl. No.: 17/029,052

(22) Filed: Sep. 23, 2020

(51) Int. Cl.
*H01R 13/64* (2006.01)
*H01R 13/46* (2006.01)

(52) U.S. Cl.
CPC ..... *H01R 13/64* (2013.01); *H01R 13/46* (2013.01)

(58) Field of Classification Search
CPC ..... H01R 13/64; H01R 13/46; H01R 13/6587
USPC ... 439/638, 540.1, 541.5, 607.04, 6, 8, 0.07, 439/0.1
See application file for complete search history.

(56) References Cited

U.S. PATENT DOCUMENTS 6,724,641 B1 * 4/2004 Hwang ..... G02B 6/4277 361/818
6,736,651 B2 * 5/2004 Ho ..... H01R 12/725 439/540.1
6,943,287 B2 * 9/2005 Lloyd ..... H01R 13/6594 174/359
6,953,370 B2 * 10/2005 Matsuoka ..... H01R 13/64 439/489
7,407,744 B2 * 8/2008 Liu ..... C07K 14/005 435/5
7,583,510 B2 * 9/2009 Wang ..... H01R 13/6593 361/753
7,601,025 B1 * 10/2009 Phillips ..... H01R 12/523 439/541.5
8,053,667 B2 * 11/2011 Chen ..... H05K 9/0058 174/50
8,182,290 B2 * 5/2012 Fonteneau ..... H05K 9/0058 439/607.21
8,203,084 B2 * 6/2012 Wertz, Jr ..... H05K 9/0058 174/368
8,426,751 B2 * 4/2013 Lee ..... H01R 13/514 174/520
8,797,736 B2 * 8/2014 Zhu ..... G06F 1/187 361/679.58

(Continued)

*Primary Examiner* — Harshad G Patel
(74) *Attorney, Agent, or Firm* — Winston Hsu

(57) ABSTRACT

An electrical connector set includes a socket and two plugs. The socket includes a connector casing forming two adjacent insertion slots. The two insertion slots are arranged in an arrangement direction and extend parallel to an insertion direction. The connector casing includes a dividing wall, separating the two insertion slots. The dividing wall has an indentation at the insertion openings of the two insertion slots. The two plugs can be inserted into the two insertion slots in the insertion direction respectively. Each plug has two protrusions at two opposite sides thereof in the arrangement direction. The two protrusions are staggered in a vertical direction perpendicular to the arrangement direction and the insertion direction. When the two plugs are inserted into the two insertion slots, the two protrusions between the two plugs are located in the indentation and staggered in the vertical direction.

11 Claims, 8 Drawing Sheets

(56) References Cited

U.S. PATENT DOCUMENTS

| | | | | |
|---|---|---|---|---|
| 9,035,199 | B2 * | 5/2015 | Janota | H05K 9/002 174/355 |
| 9,601,877 | B2 * | 3/2017 | Yang | H01R 13/659 |
| 9,620,907 | B1 * | 4/2017 | Henry | H01R 13/6582 |
| 2010/0254112 | A1 * | 10/2010 | Brown | G02B 6/4261 361/818 |
| 2016/0342563 | A1 * | 11/2016 | Tomada | G06F 13/4282 |

* cited by examiner

ELECTRICAL CONNECTOR SET, AND SOCKET AND PLUG THEREOF

BACKGROUND OF THE INVENTION

1. Field of the Invention

The present invention relates to an electrical connector, and more particularly to an electrical connector with an anti-misplugging mechanism.

2. Description of the Prior Art

Electrical connectors are used widely in applications for power or signal connection. In principle, electrical connectors of different specifications cannot be connected or exchanged with each other. However, when the size specifications of the electrical connectors are similar, misplugging may occur. In the lighter case, it is only an invalid connection; in the worst case, it causes structural damage to the electrical connector. Furthermore, some electrical connectors customized according to existing specifications may also conflict with existing electrical connectors of the specifications. In order to prevent misplugging, the general design is to set corresponding structures on the plug and socket so that the plug can only be inserted into the corresponding socket in a predetermined direction. This anti-misplugging design is usually only implemented for a single plug and a single socket, and its application scope is limited. Furthermore, the anti-misplugging prevention structure on the socket is usually located on the outer shell wall, which may cause structural interference with the structure outside the socket. For example, the anti-misplugging prevention structure on the socket is realized by protruding the side wall outward to form an inward groove.

SUMMARY OF THE INVENTION

An objective of the invention is to provide an electrical connector set, which is provided with anti-misplugging structures on a socket and a plug thereof, so that the plug can be correctly inserted into the socket.

An electrical connector set according to the invention includes a socket, a first plug, and a second plug. The socket includes a connector casing that forms a first insertion slot and a second insertion slot adjacent to the first insertion slot. The first insertion slot and the second insertion slot are arranged in an arrangement direction and extend parallel to an insertion direction. The connector casing includes a dividing wall that separates the first insertion slot and the second insertion slot in the arrangement direction. The first insertion slot has a first insertion opening. The second insertion slot has a second insertion opening. The dividing wall has an indentation at the first insertion opening and the second insertion opening. The first plug includes a first outer casing. The first outer casing has a first protrusion and a first opposite-side protrusion in the arrangement direction. The first protrusion and the first opposite-side protrusion are staggered in a vertical direction. The vertical direction is perpendicular to the arrangement direction and the insertion direction. The second plug includes a second outer casing. The second outer casing has a second protrusion and a second opposite-side protrusion in the arrangement direction. The second protrusion and the second opposite-side protrusion are staggered in the vertical direction. Therein, after the first plug is inserted into the first insertion slot with the first outer casing in the insertion direction, and the second plug is inserted into the second insertion slot with the second outer casing in the insertion direction, the first protrusion and the second opposite-side protrusion are located in the indentation and are staggered in the vertical direction.

Another objective of the invention is to provide a socket, which has an anti-misplugging structure so that a corresponding plug can be correctly inserted into the socket.

A socket according to the invention includes a connector casing that forms a first insertion slot and a second insertion slot adjacent to the first insertion slot. The first insertion slot and the second insertion slot are arranged in an arrangement direction and extend parallel to an insertion direction. The connector casing includes a dividing wall that separates the first insertion slot and the second insertion slot in the arrangement direction. The first insertion slot has a first insertion opening. The second insertion slot has a second insertion opening. The dividing wall has an indentation at the first insertion opening and the second insertion opening.

Another objective of the invention is to provide a plug, which has an anti-misplugging structure so that the plug can be correctly inserted into a corresponding socket.

A plug according to the invention includes an outer casing. The outer casing has a lengthwise direction and has a protrusion and an opposite-side protrusion in a transverse direction. The lengthwise direction is perpendicular to the transverse direction. The protrusion and the opposite-side protrusion are staggered in a vertical direction. The vertical direction is perpendicular to the lengthwise direction and the transverse direction.

Compared with the prior art, in the electrical connector set according to the invention, the indentation of the socket and the protrusions of the plug form an anti-misplugging structure that can restrict the plug into the insertion slot in the correct way. Furthermore, the indentation located inside the connector casing of the socket, which can provide structural constraint on another plug inserted into the adjacent insertion slot at the same time, and also can avoid structural interference with structures outside the socket.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
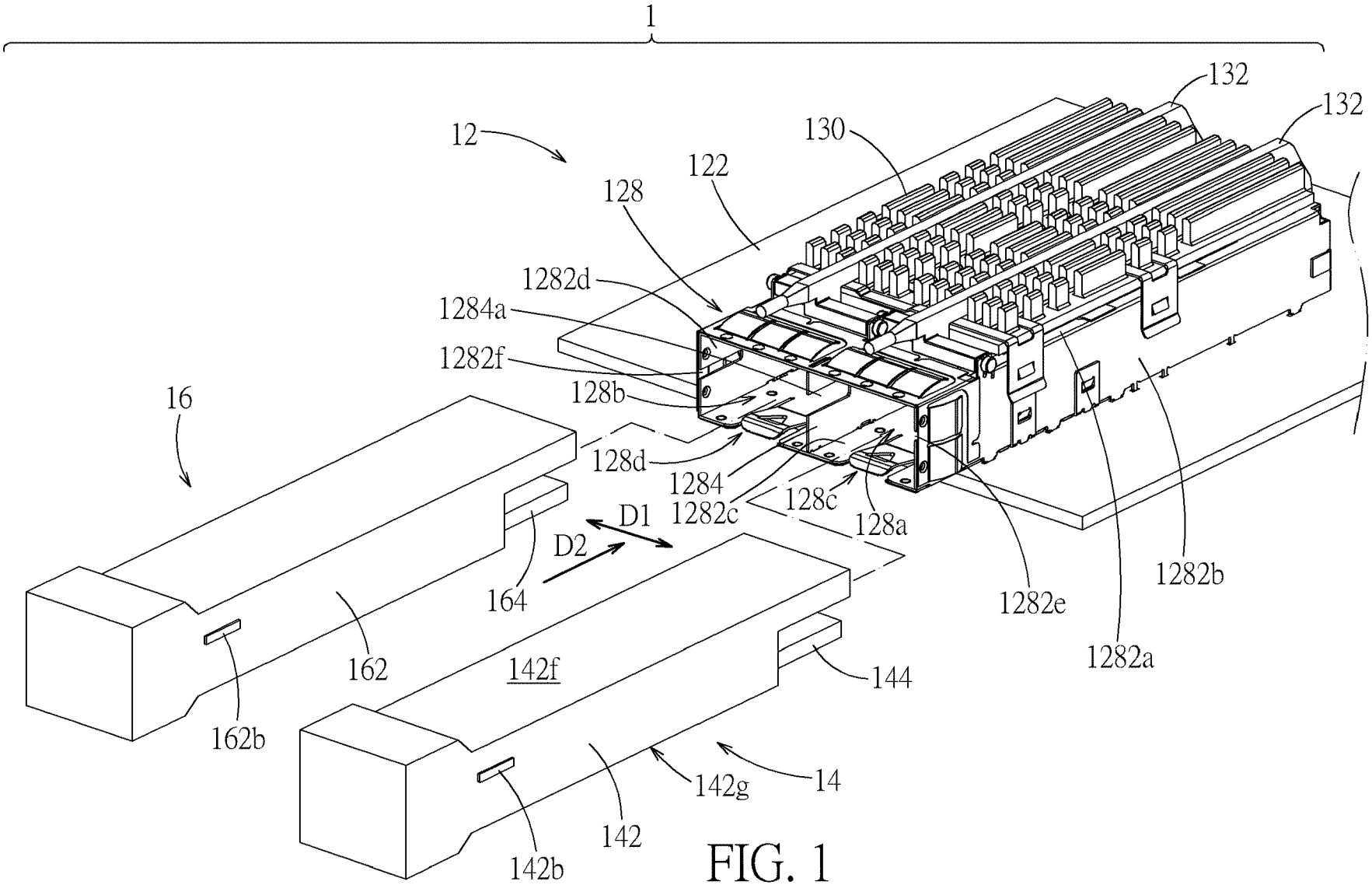
FIG. 1 is a schematic diagram illustrating an electrical connector set of an embodiment according to the invention.
Figure 2:
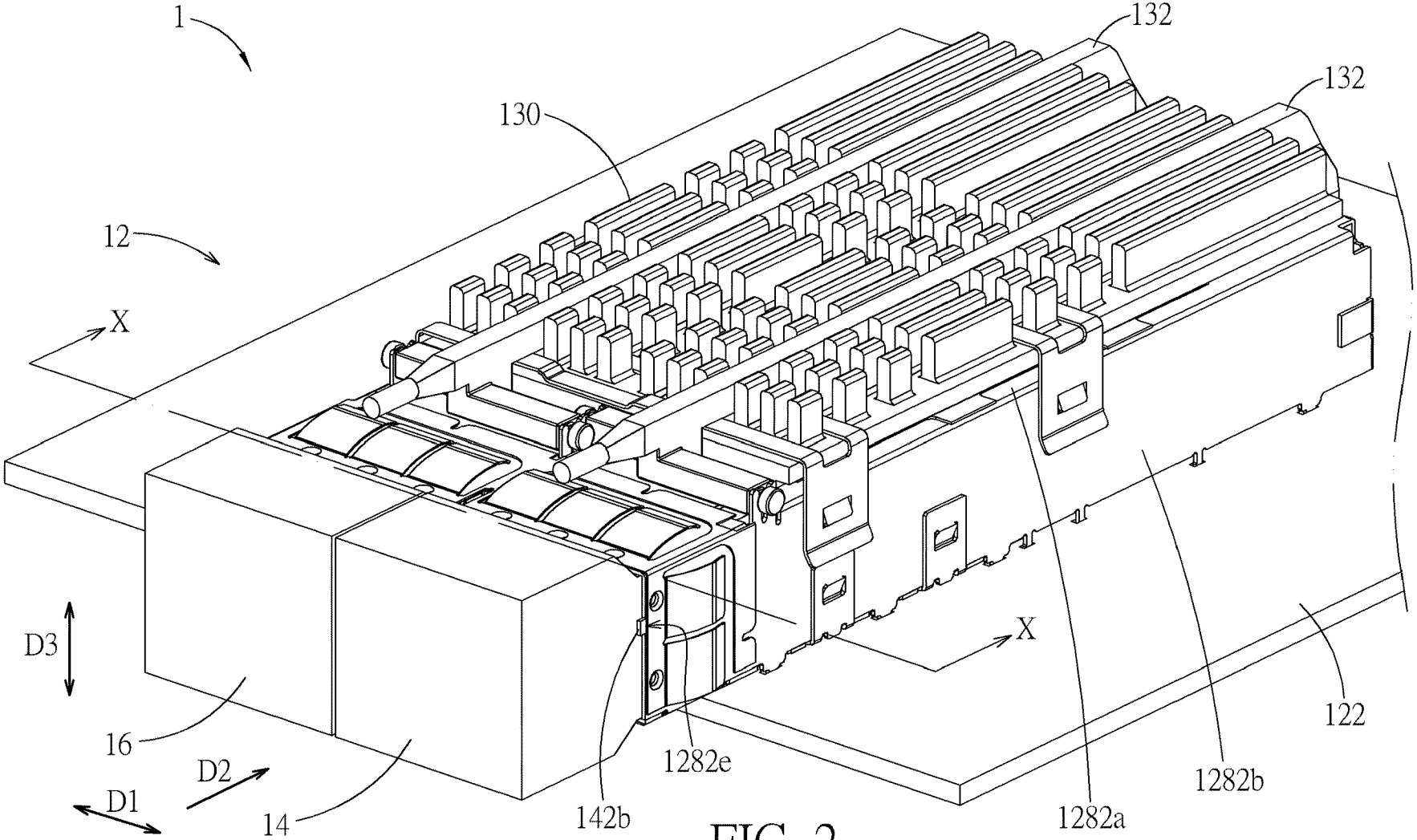
FIG. 2 is a schematic diagram illustrating that a first plug and a second plug are inserted into a socket in FIG. 1.
Figure 3:
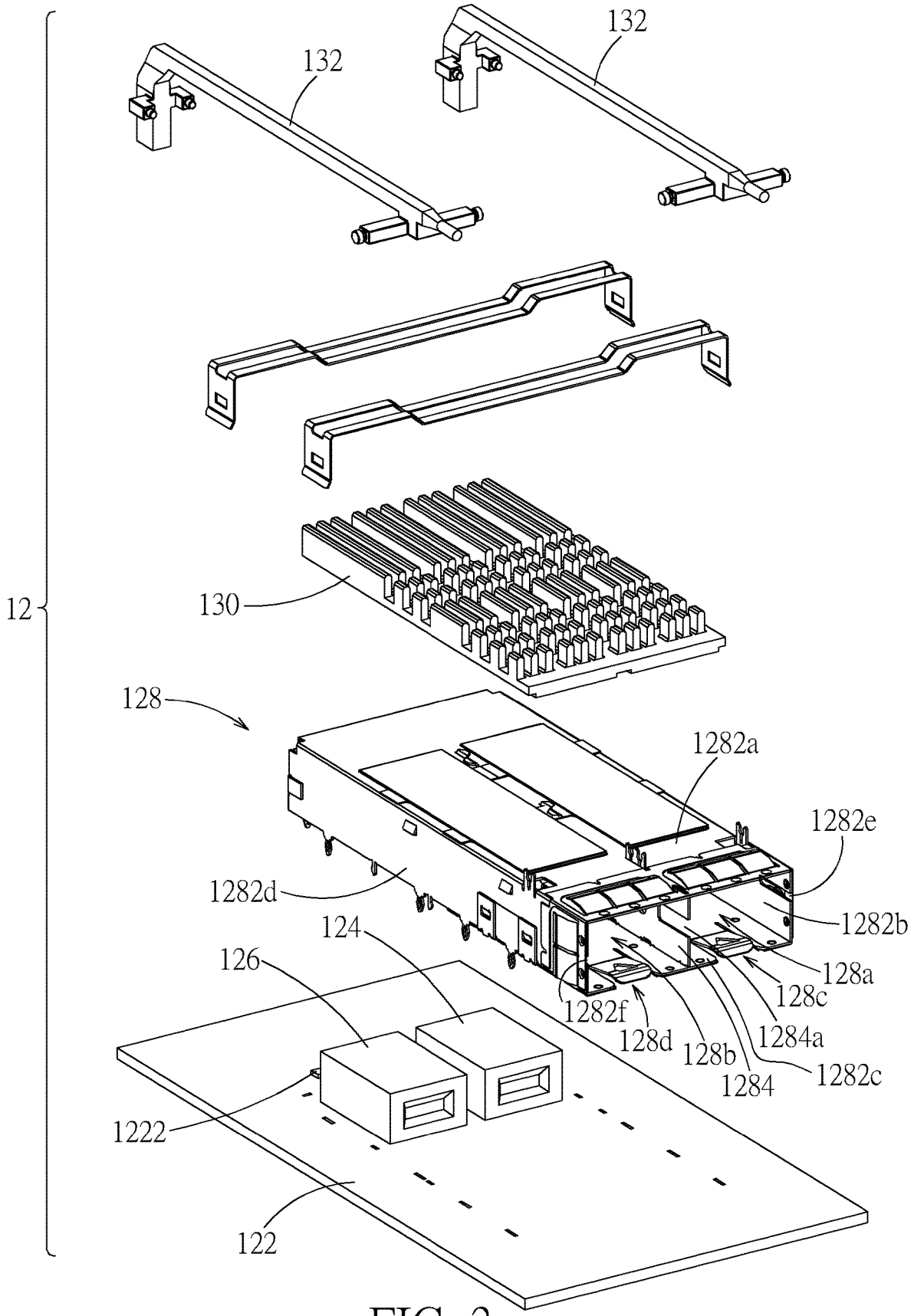
FIG. 3 is an exploded view of the socket in FIG. 1

Please refer to FIG. 1 to FIG. 3. An electrical connector set 1 according to an embodiment includes a socket 12, a first plug 14, and a second plug 16. The socket 12 includes a circuit board 122, a first electrically-connecting body 124, a second electrically-connecting body 126, a connector casing 128, a heat-dissipating structure 130, and two light-guiding structures 132. The connector casing 128 is fixed on the circuit board 122. The first and second electrically-connecting bodies 124 and 126 are electrically connected to the circuit board 122 and located in the connector casing 128. For drawing simplification, the first and second electrically-connecting bodies 124 and 126 are shown in solid blocks in the figures. In practice, the first and second electrically-connecting body 124 and 126 can be structurally integrated into a single component to facilitate assembly. The first plug 14 and the second plug 16 can be inserted into the connector casing 128 to engage with the first electrically-connecting body 124 and the second electrically-connecting body 126 respectively to achieve electrical connection. The heat-dissipating structure 130 is detachably fixed onto the connector casing 128 for dissipating heat from the electrical connector set 1 in operation. The light-guiding structure 132 is detachably fixed onto the connector casing 128 for guiding light emitted by light sources 1222 (e.g. but not limited to light-emitting diodes) on the circuit board 122 to the front side of the socket 12 for providing optical indication.

In the embodiment, the connector casing 128 includes a top wall 1282*a*, a first side wall 1282*b*, a bottom wall 1282*c* (opposite to the top wall 1282*a*), and a second side wall 1282*d* (opposite to the first side wall 1282*b*) connected in sequence. The connector casing 128 also includes a dividing wall 1284 that is connected to and between the top wall 1282*a* and the bottom wall 1282*c* and located between the first side wall 1282*b* and the second side wall 1282*d*. The connector casing 128 uses the side walls 1282*a-d* and the dividing wall 1284 to form a first insertion slot 128*a* and a second insertion slot 128*b* adjacent to the first insertion slot 128*a*. The first insertion slot 128*a* and the second insertion slot 128*b* are arranged in an arrangement direction D1 (indicated by a double-headed arrow in the figures) and extend in an insertion direction D2 (indicated by an arrow in the figures). The dividing wall 1284 separates the first insertion slot 128*a* and the second insertion slot 128*b* in the arrangement direction D1. The first insertion slot 128*a* has a first insertion opening 128*c*. The first plug 14 can be inserted into the first insertion slot 128*a* through the first insertion opening 128*c* in the insertion direction D2. The second insertion slot 128*b* has a second insertion opening 128*d*. The second plug 16 can be inserted into the second insertion slot 128*b* through the second insertion opening 128*d* in the insertion direction D2. The dividing wall 1284 has a first indentation 1284*a* at the first insertion opening 128*c* and the second insertion opening 128*d*. The first side wall 1282*b* is located at another side of the first insertion slot 128*a* opposite to the dividing wall 1284 in the arrangement direction D1 and has a second indentation 1282*e* at the first insertion opening 128*c*. The second side wall 1282*d* is located at another side of the second insertion slot 128*b* opposite to the dividing wall 1284 in the arrangement direction D1 and has a third indentation 1282*f* at the second insertion opening 128*d*.

Figure 4:
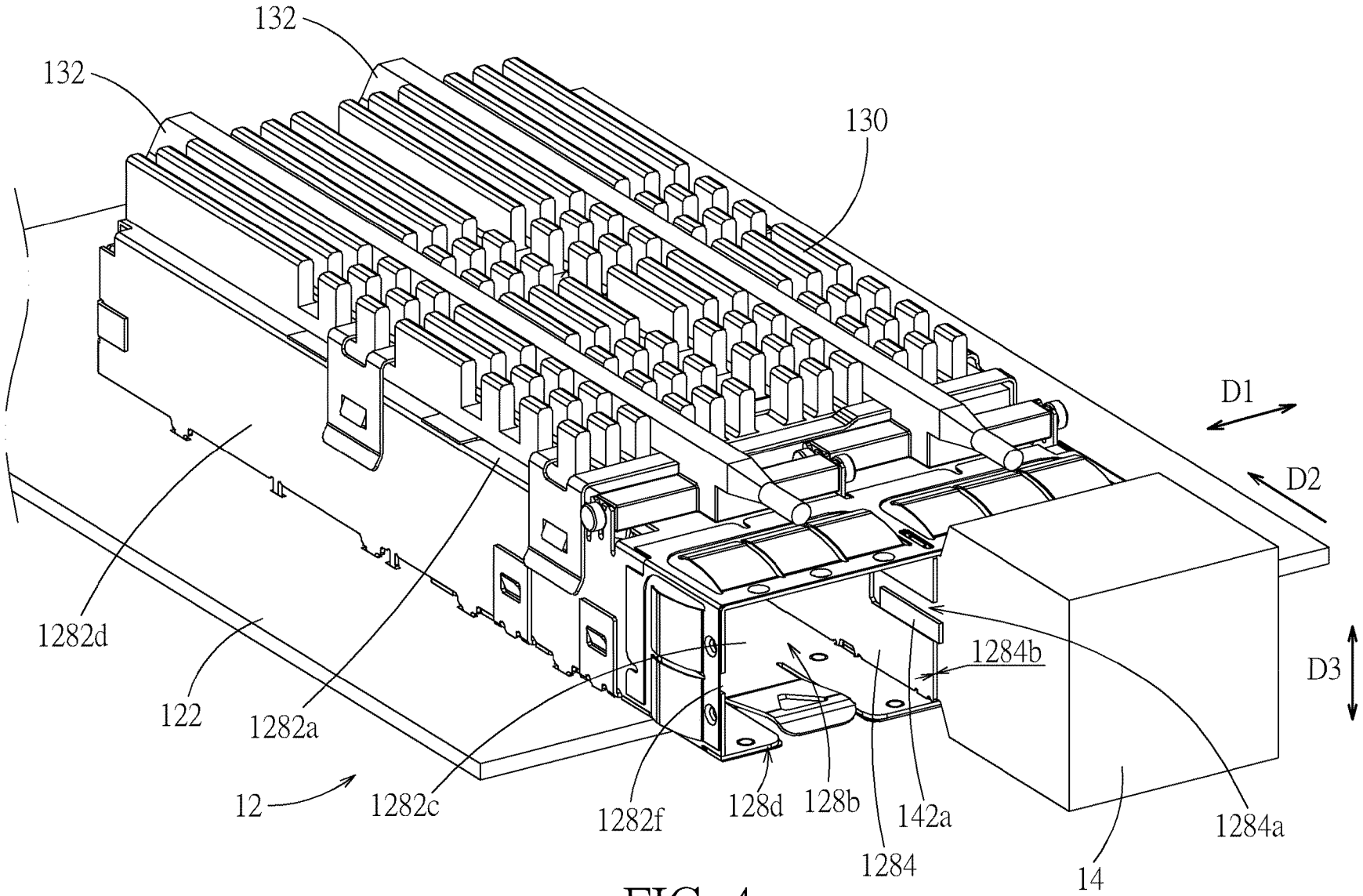
FIG. 4 is a schematic diagram illustrating that only the first plug is inserted into the socket in FIG. 1 in another view point.
Figure 5:
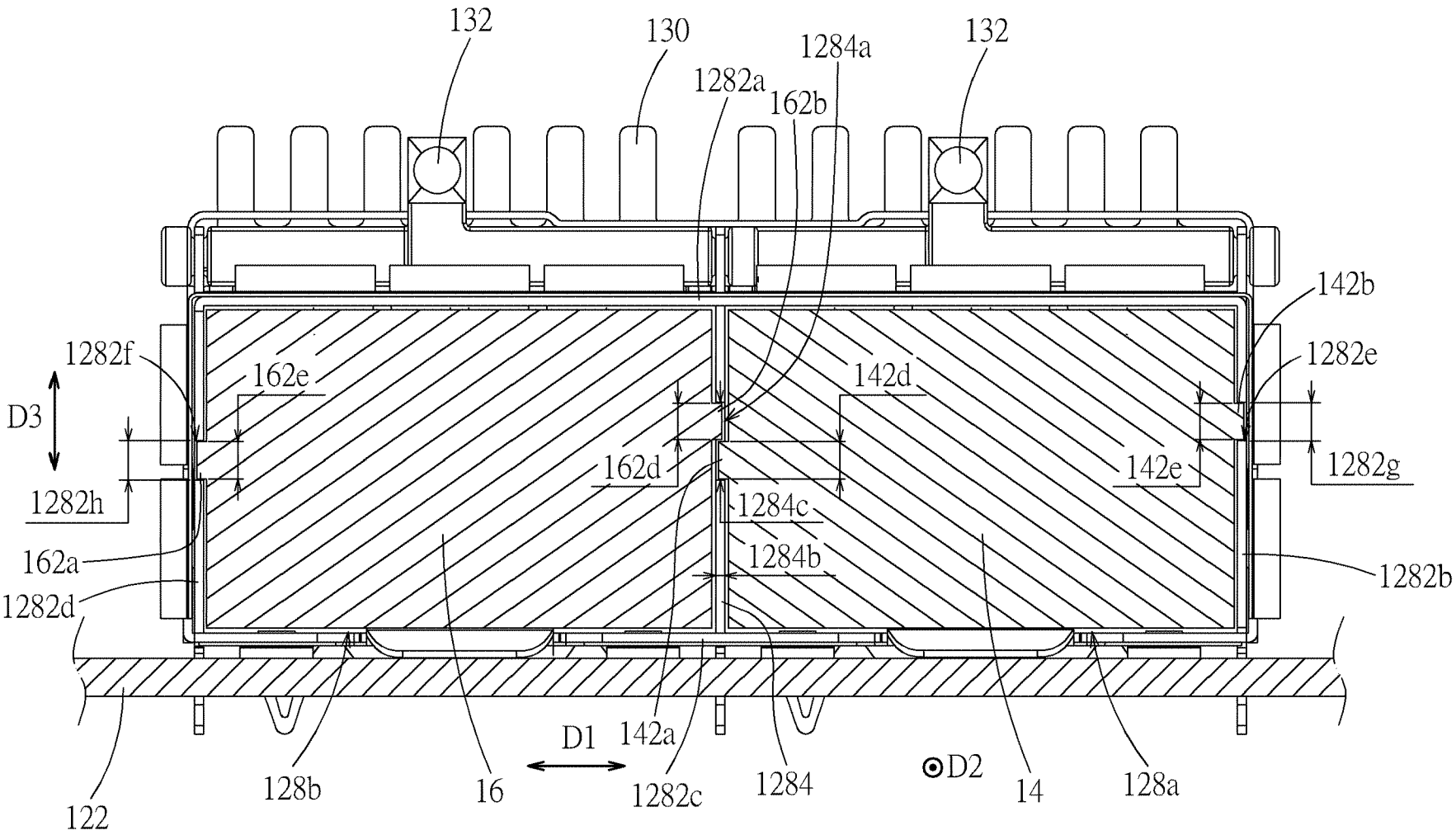
FIG. 5 is a sectional view of the electrical connector set in FIG. 2 along the line X-X.

Please also refer to FIG. 4 and FIG. 5; in FIG. 5, the first plug 14 and the second plug 16 are shown in solid blocks for drawing simplification. The first plug 14 includes a first outer casing 142 and a first mating electrically-connecting body 144. The first mating electrically-connecting body 144 is disposed in the first outer casing 142 and exposed to be able to engage with the first electrically-connecting body 124 (e.g. protruding from the first outer casing 142). The first outer casing 142 has a first protrusion 142*a* and a first opposite-side protrusion 142*b* in the arrangement direction D2. The first protrusion 142*a* and the first opposite-side protrusion 142*b* are staggered in a vertical direction D3 (indicated by a double-headed arrow in the figures). The vertical direction D3 is perpendicular to the arrangement direction D1 and the insertion direction D2. After the first plug 14 is inserted into the first insertion slot 128*a* with the first outer casing 142 in the insertion direction D2, the first mating electrically-connecting body 144 is engaged with the first electrically-connecting body 124, the first protrusion 142*a* is located in the first indentation 1284*a*, and the first opposite-side protrusion 142*b* is located in the second indentation 1282*e*.

The second plug 16 includes a second outer casing 162 and a second mating electrically-connecting body 164. The second mating electrically-connecting body 164 is disposed in the second outer casing 162 and exposed to be able to engage with the second electrically-connecting body 126. The second outer casing 162 has a second protrusion 162*a* and a second opposite-side protrusion 162*b* in the arrangement direction D2. The second protrusion 162*a* and the second opposite-side protrusion 162*b* are staggered in the vertical direction D3. After the second plug 16 is inserted into the second insertion slot 128*b* with the second outer casing 162 in the insertion direction D2, the second mating electrically-connecting body 164 is engaged with the second electrically-connecting body 126, the second opposite-side protrusion 162*b* is located in the first indentation 1284*a*, and the second protrusion 162*a* is located in the third indentation 1282*f*.

The socket 12 uses the indentations 1284*a*, 1282*e* and 1282*f* on the connector casing 128 to avoid structural interference with the protrusions 142*a*, 142*b*, 162*a* and 162*b*. At the same time, by the identifications 1284*a*, 1282*e* and 1282*f* in coordination with the protrusions 142*a*, 142*b*, 162*a* and 162*b*, whether the plugs 14 and 16 are inserted into the correct socket 12 can be confirmed (for example, a conventional socket does not has an indentation structure, so the plugs 14 and 16 cannot be fully inserted, which can prevent the plugs 14 and 16 from being damaged due to misplugging). In the embodiment, after the plugs 14 and 16 are inserted into the socket 12, the first protrusion 142*a* and the second opposite-side protrusion 162*b* are simultaneously located in the first indentation 1284*a* and staggered in the vertical direction D3, so that structural interference between the plugs 14 and 16 can be avoided. Furthermore, after the plugs 14 and 16 are inserted in the socket 12, the first protrusion 142*a* will not enter the second insertion slot 128*b*, and the second opposite-side protrusion 162*b* will not enter the first insertion slot 128*a*, so that structural interference between the plugs 14 and 16 in the arrangement direction D1 can be avoided. This structural configuration can be achieved by designing the protruding heights of the first protrusion 142*a* and the second opposite-side protrusion 162*b*. For example, the protruding heights of the first protrusion 142*a* and the second opposite-side protrusion 162*b* is less than or equal to the thickness 1284*b* of the dividing wall 1284 in the arrangement direction D1.

Furthermore, in the embodiment, in practice, the design of the size (or the length 1284*c* in the vertical direction D3) and location of the first indentation 1284*a* is based on the principle that the first protrusion 142*a* and the second opposite-side protrusion 162*b* can be accommodated. For example, in the vertical direction D3, if the first protrusion 142*a* and the second opposite-side protrusion 162*b* abut against each other and also abut against the edges of the first indentation 1284*a*, the sum of the length 142*d* of the first protrusion 142*a* and the length 162*d* of the second opposite-side protrusion 162*b* is equal to the length 1284*c* of the first indentation 1284*a*. For another example, in the vertical direction D3, if the first protrusion 142*a* and the second opposite-side protrusion 162*b* are separated and may or may not abut against the edges of the first indentation 1284*a*, the sum of the length 142*d* of the first protrusion 142*a* and the length 162*d* of the second opposite-side protrusion 162*b* is less than the length 1284*c* of the first indentation 1284*a*. Similarly, in practice, the length 1282*g* of the second indentation 1282*e* is greater than or equal to the length 142*e* of the first opposite-side protrusion 142*b*, and the length 1282*h* of the third indentation 1282*f* is greater than or equal to the length 162*e* of the second protrusion 162*a*.

Figure 6:
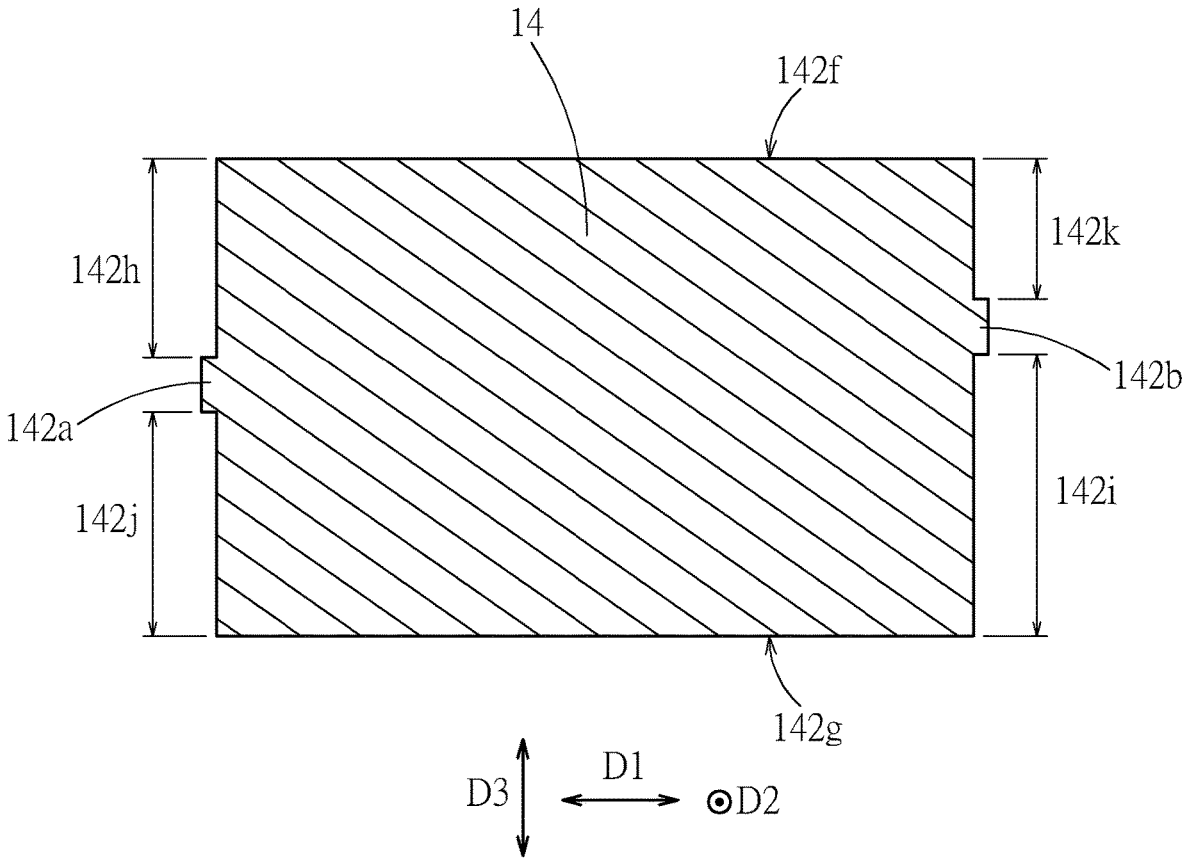
FIG. 6 is a schematic diagram illustrating the first plug in FIG. 5.

In addition, in the embodiment, in the vertical direction D3, the first indentation 1284*a* is located above the middle of the first insertion slot 128*a*, which is conducive to preventing the plugs 14 and 16 from being inserted into the socket 12 after rotating 180 degrees relative to the insertion direction D2. For the first plug 14, as shown by FIG. 6, in the vertical direction D3, the first outer casing 142 has an upper surface 142*f* and a lower surface 142*g* opposite to the upper surface 142*f*. In principle, if the positional relationship of the first protrusion 142*a* with respect to the upper surface 142*f* and the lower surface 142*g* is different from that of the first opposite side protrusion 142*b*, the state of the first plug 14 before and after rotating 180 degrees relative to the insertion direction D2 is different, which in coordination with of the indentations 1284*a* and 1282 can easily prevent misplugging of the first plug 14 after rotating 180 degrees. For example, in FIG. 6, the distance 142*h* between the first protrusion 142*a* and the upper surface 142*f* is different from the distance 142*i* between the first opposite-side protrusion 142*b* and the lower surface 142*g*, or the distance 142*j* between the first protrusion 142*a* and the lower surface 142*g* is different from the distance 142*k* between the first opposite-side protrusion 142*b* and the upper surface 142*f*.

Figure 7:
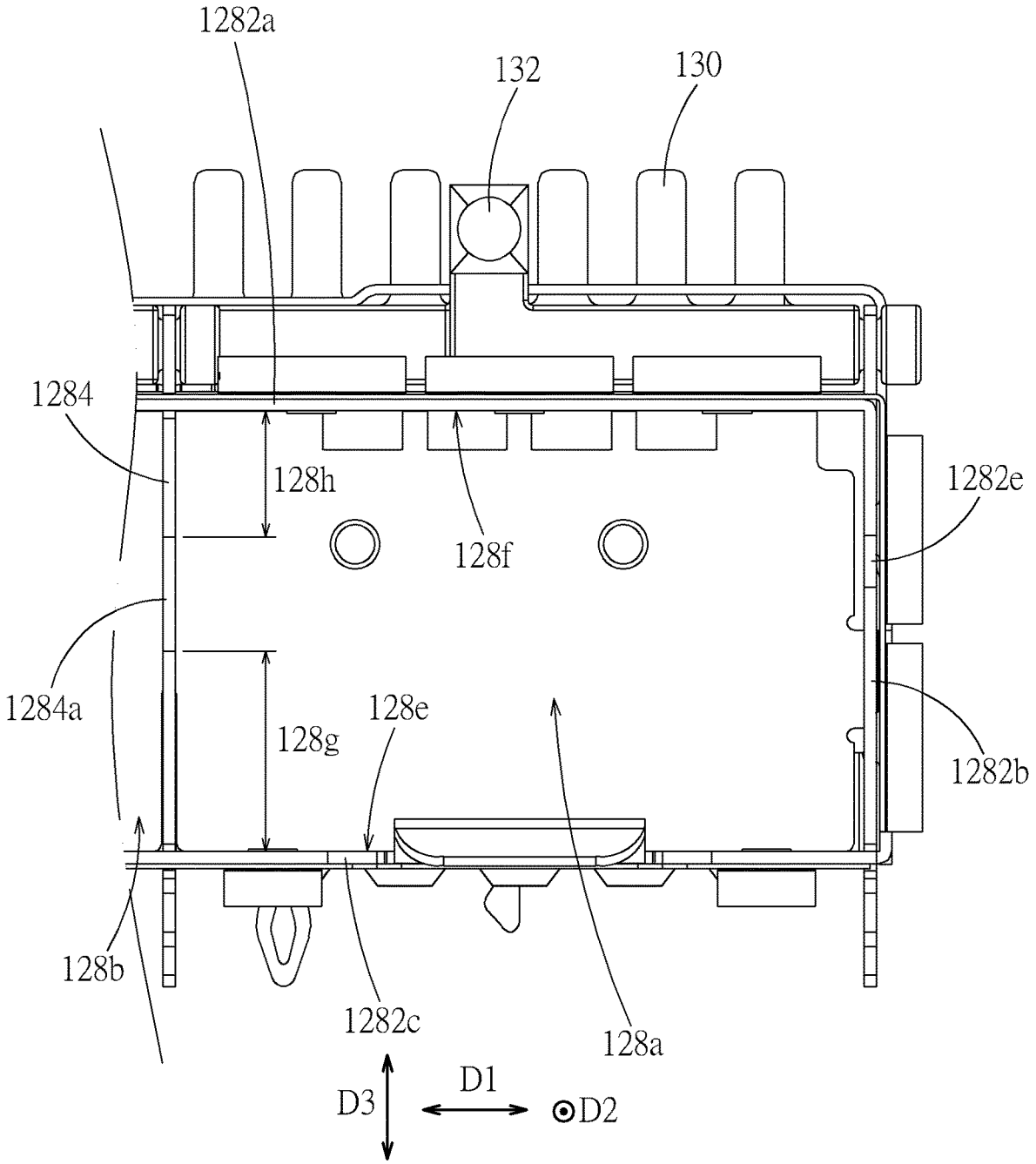
FIG. 7 is a schematic diagram illustrating a portion of a connector casing related to a first insertion slot in FIG. 5.

Similarly, for the first insertion slot 128*a*, as shown by FIG. 7, in the vertical direction D3, the first insertion slot 128*a* has a bottom surface 128*e* and a top surface 128*f* opposite to the bottom surface 128*e*. The distance 128*g* between the first indentation 1284*a* and the bottom surface 128*e* is different from the distance 128*h* between the first indentation 1284*a* and the top surface 128*f*, which, in principle, can make the first opposite-side protrusion 142*b* be unable to enter the first indentation 1284*a* after the first plug 14 rotates 180 degrees relative to the insertion direction D2, so as to realize an anti-misplugging mechanism.

Figure 8:
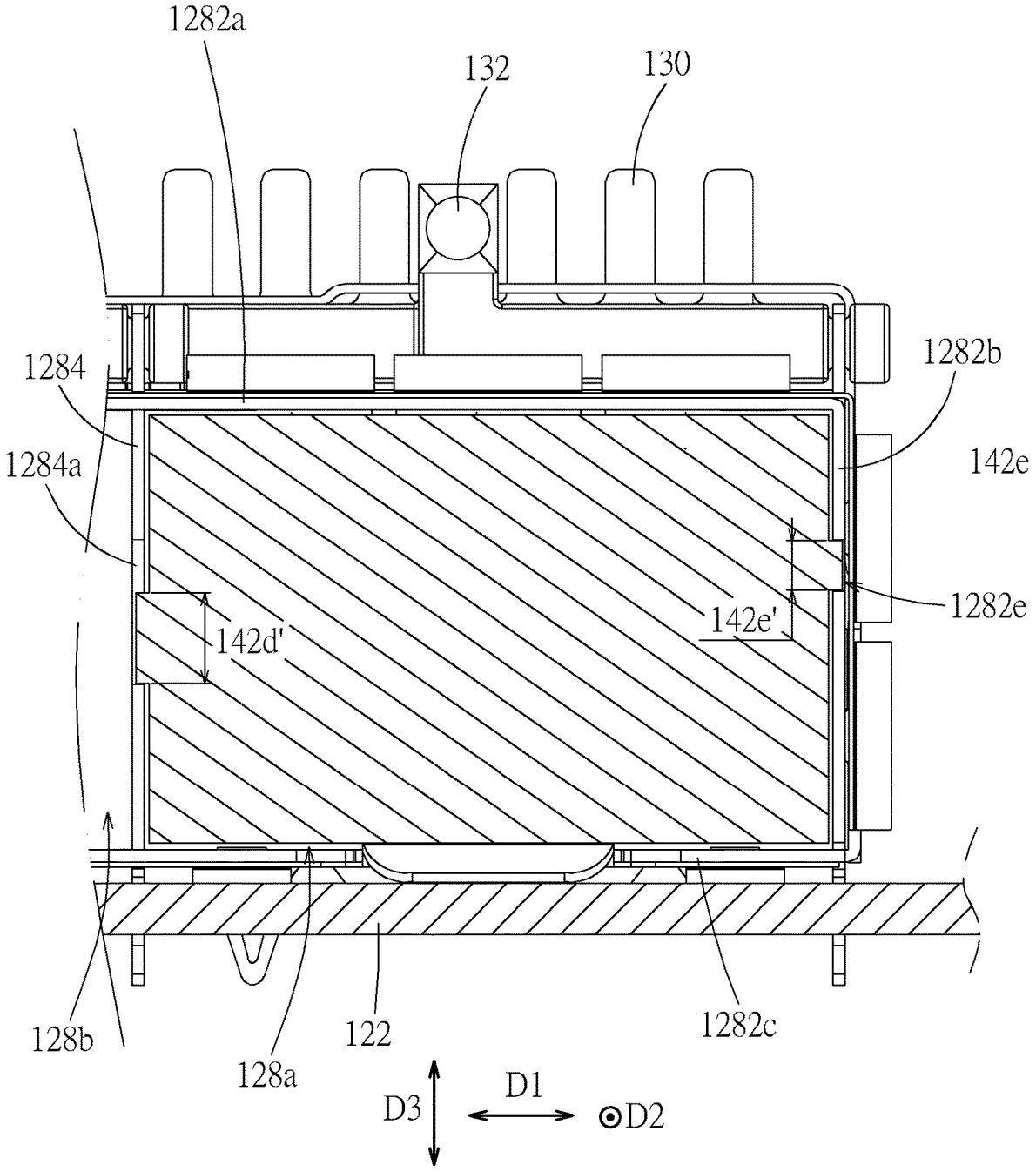
FIG. 8 is a sectional view of the first plug inserted into the socket according to a variation.

Furthermore, in the embodiment, the lengths 142*d* and 142*e* of the first protrusion 142*a* and the first opposite-side protrusion 142*b* in the vertical direction D3 are equal; however, it is not limited thereto in practice. For example, as shown by FIG. 8, if the lengths 142*d*' and 142*e*' of the first protrusion 142*a* and the first opposite-side protrusion 142*b* are different, the state of the first plug 14 before and after rotating 180 degrees relative to the insertion direction D2 still can be different even when the first indentation 1284*a* is located at the middle of the first insertion slot 128*a*. Therein, the length 142*d*' of the first protrusion 142*a* is greater than the length 142*e*' of the first opposite-side protrusion 142*b*, and the length of the second indentation 1282*e* matches the length 142*e*'. Therefore, after the first plug 14 rotates 180 degrees, the first protrusion 142*a* will not enter the second indentation 1282*e*, which also can prevent the plugs 14 and 16 from being inserted into the socket 12 after rotating 180 degrees relative to the insertion direction D2.

In addition, the electrical connector set 1 in the embodiment is illustrated on the fact that the first plug 14 and the second plug 16 have the same structure. For other descriptions about the second plug 16 and its matching second insertion slot 128*b*, first indentation 1284*a* and third indentation 1282*f*, etc., please refer to the relevant descriptions of first plug 14 and its matching first insertion slot 128*a*, first indentation 1284*a*, second indentation 1282*e*, etc. (including variations thereof), which will not be described in addition. However, it is not limited thereto in practice. Based on the previous descriptions of the structural relationships between the indentations 1284*a*, 1282*e* and 1282*f* and the protrusions 142*a*, 142*b*, 162*a* and 162*b*, in practice, in the cases in which the first plug 14 and the second plug 16 have different structures (in which the connector casing 128 and the electrically-connecting bodies 124 and 126 are modified correspondingly), the same anti-misplugging mechanism still can be achieved, which will not be described in addition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical connector set, comprising:

a socket, comprising;

a connector casing, forming a first insertion slot and a second insertion slot adjacent to the first insertion slot, the first insertion slot and the second insertion slot being arranged in an arrangement direction and extending parallel to an insertion direction, the connector casing comprising a dividing wall separating the first insertion slot and the second insertion slot in the arrangement direction, the first insertion slot having a first insertion opening, the second insertion slot having a second insertion opening, the dividing wall having a first indentation at the first insertion opening and the second insertion opening;

a first plug, comprising:

a first outer casing, having a first protrusion and a first opposite-side protrusion in the arrangement direction, the first protrusion and the first opposite-side protrusion being staggered in a vertical direction, the vertical direction being perpendicular to the arrangement direction and the insertion direction; and a second plug, comprising:

a second outer casing, having a second protrusion and a second opposite-side protrusion in the arrangement direction, the second protrusion and the second opposite-side protrusion being staggered in the vertical direction;

wherein after the first plug is inserted into the first insertion slot with the first outer casing in the insertion direction, and the second plug is inserted into the second insertion slot with the second outer casing in the insertion direction, the first protrusion and the second opposite-side protrusion are located in the first indentation and are staggered in the vertical direction.

2. The electrical connector set according to claim 1, wherein the connector casing comprises a first side wall, located at another side of the first insertion slot opposite to the dividing wall, the first side wall has a second indentation, located at the first insertion opening, and after the first plug is inserted into the first insertion slot, the first opposite-side protrusion is located in the second indentation.

3. The electrical connector set according to claim 2, wherein in the vertical direction, a length of the second indentation is greater than or equal to a length of the first opposite-side protrusion.

4. The electrical connector set according to claim 1, wherein the connector casing comprises a second side wall, located at another side of the second insertion slot opposite to the dividing wall, the second side wall has a third indentation, located at the second insertion opening, and after the second plug is inserted into the second insertion slot, the second protrusion is located in the third indentation.

5. The electrical connector set according to claim 1, wherein protruding heights of the first protrusion and the second opposite-side protrusion are less than or equal to a thickness of the dividing wall in the arrangement direction.

6. The electrical connector set according to claim 1, wherein in the vertical direction, a sum of a length of the first protrusion and a length of the second opposite-side protrusion is less than or equal to a length of the first indentation.

7. The electrical connector set according to claim 1, wherein in the vertical direction, the first outer casing has an upper surface and a lower surface opposite to the upper surface, and a distance between the first protrusion and the upper surface is different from a distance between the first opposite-side protrusion and the lower surface.

8. The electrical connector set according to claim 1, wherein in the vertical direction, the first insertion slot has a bottom surface and a top surface opposite to the bottom surface, and a distance between the first indentation and the bottom surface is different from a distance between the first indentation and the top surface.

9. The electrical connector set according to claim 1, wherein in the vertical direction, a length of the first protrusion is different from a length of the first opposite-side protrusion.

10. The electrical connector set according to claim 1, wherein the socket comprises a first electrically-connecting body and a second electrically-connecting body, disposed in the connector casing and exposed from the first insertion slot and the second insertion slot, the first plug comprises a first mating electrically-connecting body, disposed in the first outer casing, the second plug comprises a second mating electrically-connecting body, disposed in the second outer casing, and after the first plug and the second plug are inserted into the first insertion slot and the second insertion slot, the first and second mating electrically-connecting bodies are engaged with the first and second electrically-connecting bodies respectively.

11. The electrical connector set according to claim 1, wherein the first plug and the second plug are the same in structure.

* * * * *